US008646649B2

(12) United States Patent
Kobayashi

(10) Patent No.: US 8,646,649 B2
(45) Date of Patent: Feb. 11, 2014

(54) BUSINESS CARD CASE

(75) Inventor: Shinichi Kobayashi, Kanagawa (JP)

(73) Assignee: Katoh Electrical Machinery Co., Ltd., Kanagawa (JP)

( * ) Notice: Subject to any disclaimer, the term of this patent is extended or adjusted under 35 U.S.C. 154(b) by 15 days.

(21) Appl. No.: 13/406,951

(22) Filed: Feb. 28, 2012

(65) Prior Publication Data

US 2012/0234855 A1 Sep. 20, 2012

(30) Foreign Application Priority Data

Mar. 14, 2011 (JP) ..... 2011-055887

(51) Int. Cl.
*B65D 83/08* (2006.01)
*B65H 3/00* (2006.01)
*B65G 59/02* (2006.01)

(52) U.S. Cl.
USPC ..... 221/41; 221/312 R; 221/261; 221/251; 221/270

(58) Field of Classification Search
USPC ..... 221/261, 251, 269–271, 312 R, 55, 41
See application file for complete search history.

(56) References Cited

U.S. PATENT DOCUMENTS 1,697,366 A * 1/1929 Opfergelt ..... 221/232
1,734,644 A * 11/1929 Ostrander et al. ..... 221/232
2,557,323 A * 6/1951 Testi ..... 221/33
3,133,672 A * 5/1964 Thomasma et al. ..... 221/26
3,563,412 A * 2/1971 James ..... 221/224
4,790,435 A * 12/1988 Trusty ..... 206/39.5
4,887,739 A * 12/1989 Parker ..... 221/232
5,615,800 A * 4/1997 Meyers ..... 221/232
5,730,319 A * 3/1998 Gray et al. ..... 221/259
6,318,590 B1 * 11/2001 McMurray-Stivers ..... 221/45
7,841,488 B2 * 11/2010 Hagihara et al. ..... 221/45
2011/0108565 A1 * 5/2011 Patton et al. ..... 221/37

FOREIGN PATENT DOCUMENTS

JP 62-63020 4/1987
JP 3108210 2/2005
JP 2012-16859 1/2012

* cited by examiner

*Primary Examiner* — Michael K Collins
(74) *Attorney, Agent, or Firm* — Notaro, Michalos & Zaccaria P.C.

(57) ABSTRACT

In order to provide a card case in which cards can be securely discharged one by one to the last one, it comprises a storage case which has a card insertion inlet and a card discharging opening, can accommodate several cards inside and comprises a lower case and an upper case; a card push-up piece for pushing up the stored cards as a whole toward the upper case; a card discharging unit with a component with a locking part for locking the uppermost one of the several cards and provided on the upper case so as to be slidable toward the card discharging opening; a guide part provided close to the card discharging opening so as to incline the tip of the card obliquely downward; and a stopper provided close to the card discharging opening so as to prevent the second and lower cards (from the uppermost one) of the several cards from being pushed out of the card discharging opening.

5 Claims, 24 Drawing Sheets

BUSINESS CARD CASE

FIELD OF THE INVENTION

The present invention relates to a business card case or name card case, wherein a plurality of cards are stored and they can be sequentially and securely discharged one by one or securely discharged one by one in a semi-automatic manner, as necessary; such a business card case or name card case is further intended to eliminate various inconveniences of conventional products.

BACKGROUND OF THE INVENTION

Conventionally, business card cases or name card cases have been known in the art, such as those disclosed in JP Registered Utility Model Publication No. 3108210 or JP Utility Model Publication No. S62-63020. One commonly known business card case or name card case lies in that a discharging opening of business cards or a name cards (hereinafter called cards) is provided on a storage case for storing a plurality of cards, and the stored cards are lifted upward by lifting means provided on a bottom portion of the storage case using elastic means such as a leaf spring. The card lifted upwardly can be pushed out one by one by inserting a finger into a window portion provided on a cover and by sliding the card via frictional force generated between the finger and the card. Another commonly known business card case or name card case comprises lifting means as well, and a discharging button member thereof is slidably mounted on a cover; the card can be pushed out through a discharging opening by locking an end of a card at the top of the stack using a locking portion provided on the discharging button.

Of these business card cases or name card cases, the one disclosed in JP Registered Utility Model Publication No. 3108210 has a problem that a strong pressure on cards pushes them downwards, which complicates a discharging operation from a discharging opening, since the cards stored in a storage case need to be pushed out by fingers. Another problem is that the above-mentioned problem worsens in that elastic force of elastic means of lifting means is weakened by a smaller number of the cards stored in a storage case.

Moreover, the one described in JP Utility Model Publication No. S62-63020, in which end portion of a card is caught by a locking portion of a discharging button member and the card is pushed toward a discharging opening by pressing the discharging button member, is also disadvantageous in that a portion of the card locked by the locking portion of the discharging button member has a thickness corresponding to that of the card itself only, so that one often fails to discharge the card, which requires repeated trials for discharging the card. Still further, in the business card cases or name card case disclosed in JP Utility Model Publication No. S62-63020, it is necessary to manually return a discharging button to the original position, which makes an operation complicated.

To solve the above-mentioned problem, the present inventor has previously disclosed an invention according to JP Patent Application No. 2010-154826.

However, conventional business card cases or name card cases, including those described in the above-mentioned patent documents, have still a variety of inconveniences as follows:

Namely, the inconveniences of the conventional card cases are for example: (1) that a discharging operation of a single card is liable to lead to malfunctions, i.e. failure in discharging even a single card, or discharge of more than one cards; (2) that one sometimes fails to securely discharge to the last one of the stored cards; (3) that these card cases show unsatisfactory durability performance; (4) that those using a movable lid are unstable in function; (5) the card cases themselves become thick; (6) one often faces difficulties in storing or replacing the cards; (7) that one cannot see how many cards remain in the storage case; and (8) the cards given from others etc. cannot be temporarily stored; in this manner, these card cases leave a lot of room for improvement.

SUMMARY OF THE INVENTION

The invention is made to solve the above-mentioned problems. An object of the invention is provide a business card case or name card case, wherein cards stored in a storage case can be sequentially and securely discharged one by one or securely discharged one by one in a semi-automatic manner to the last card; wherein it shows an excellent durability performance; wherein it is thin; wherein the cards can be easily stored or replaced; wherein it is readily visible how many cards remain in the storage case; and wherein the cards given from others etc. can be temporarily stored.

To achieve the above-mentioned object, the invention is designed as follows, as disclosed in each aspect of the invention.

Namely, a business card case or name card case according to the invention as disclosed in a first aspect is characterized in that it comprises a storage case provided with a card insertion inlet on one side and with a card discharging opening on one other side in a direction perpendicular to the above-mentioned card insertion inlet, the above-mentioned storage case capable of storing a plurality of cards stacked one on top of each other in the inside thereof; a card insertion inlet opening/closing means comprising an opening/closing cover provided so as to be slidable in an upward-downward direction perpendicular to the above-mentioned card insertion inlet; a card push-up means comprising a push-up plate movable in upward-downward direction inside a storage case and elastic means provided so as to push up the push-up plate; a card discharging mechanism having a discharging button member with a locking portion for locking the uppermost one of the above-mentioned plurality of cards, the above-mentioned discharging button member being provided so as to be slidable toward the above-mentioned card discharging opening; and an automatic restoration means having an elastic means, the above-mentioned automatic restoration means automatically restoring the above-mentioned discharging button member to the original position after slide operation of the above-mentioned discharging button member toward the above-mentioned card discharging opening; wherein the above-mentioned card discharging opening comprises a stopper so shaped on a central portion on a lower side that the above-mentioned stopper is higher than both sides, an inclined portion provided outwards as a whole, including the above-mentioned stopper, a guide portion so provided that the above-mentioned guide portion as a whole has less inclination than the above-mentioned inclined portion.

A business card case or name card case according to the invention as disclosed in a second aspect is characterized in that the above-mentioned locking portion of the above-mentioned card discharging mechanism is formed in stepped shape of two or more levels.

A business card case or name card case according to the invention as disclosed in a third aspect is characterized in that an opening/closing cover is provided on the above-mentioned card insertion inlet, and that the opening/closing cover is so designed that the above-mentioned card push-up means is pushed down together with the opening/closing cover.

A business card case or name card case according to the invention as disclosed in a third aspect is characterized in that an opening/closing cover is engaged with the above-mentioned push-up plate, and the above-mentioned opening/closing cover is so designed that the above-mentioned push-up plate is pushed down on the card insertion inlet side, together with the above-mentioned opening/closing cover, when the latter is pushed down.

A business card case or name card case according to the invention as disclosed in a fifth aspect is characterized in that a pocket portion is provided on a lower surface of a lower case of the above-mentioned card case.

According to the present invention, the invention according to a first aspect enables to sequentially and securely push out cards in a storage case one by one or securely push out one by one in a semi-automatic manner from a discharging opening, by a cooperative effect between a card push-up means for pushing up the whole cards toward the upper case, a member with a locking portion for locking the uppermost card of a plurality of cards as mentioned above, and a stopper for preventing a second and lower cards (from the uppermost one) from being pushed out of the above-mentioned card discharging opening. Moreover, the storage case is constructed by firmly fixing a lower case and an upper case to each other and a card discharging mechanism is provided on the upper case, so that an operation is stabilized and durability is enhanced, as compared to the conventional business card cases or name card cases, wherein a card discharging mechanism is provided on a movable lid.

The invention according to a second aspect can achieve a secure discharging operation of cards, since the above-mentioned locking portion of the above-mentioned card discharging mechanism is formed in stepped shape of two or more levels, and this enables a second stepped portion or lower to catch the cards, even in case of failure in catching the cards at a first stepped portion.

The invention according to a third aspect facilitates storing or replacing operations of cards comparison with a movable cover provided with a portion of the storage case, since an opening/closing cover provided on a card insertion inlet assures stability in operation. Moreover, a configuration in which a push-up plate of a card push-up means is also pushed down together with the opening/closing cover by a push-down operation of the above-mentioned opening/closing cover, and this facilitates storing or replacing operations of all of the cards through the above-mentioned card insertion inlet.

The invention according to a fourth aspect enables to see from outside and check how many cards remain in a storage case, by providing an openable/closable transparent window member on a side opposite to the side with the above-mentioned opening/closing cover of the above-mentioned storage case. Still further, a design of a transparent window member which is openable/closable facilitates replacing operations of cards as a whole, since it is possible to collectively discharge the cards inside, by opening both of the transparent window member and the above-mentioned opening/closing cover, and inserting fingers through an opening created by opening the transparent window member and pushing a side edge of the cards as a whole using the fingers.

The invention according to a fifth aspect enables to temporarily store the cards given from others and cash cards etc. by providing a pocket portion on a lower surface of the above-mentioned lower case.

EMBODIMENT

In the following, an embodiment of a business card case/name card case (hereinafter called card case) according to the invention will be described based on the drawings.

Figure 18:
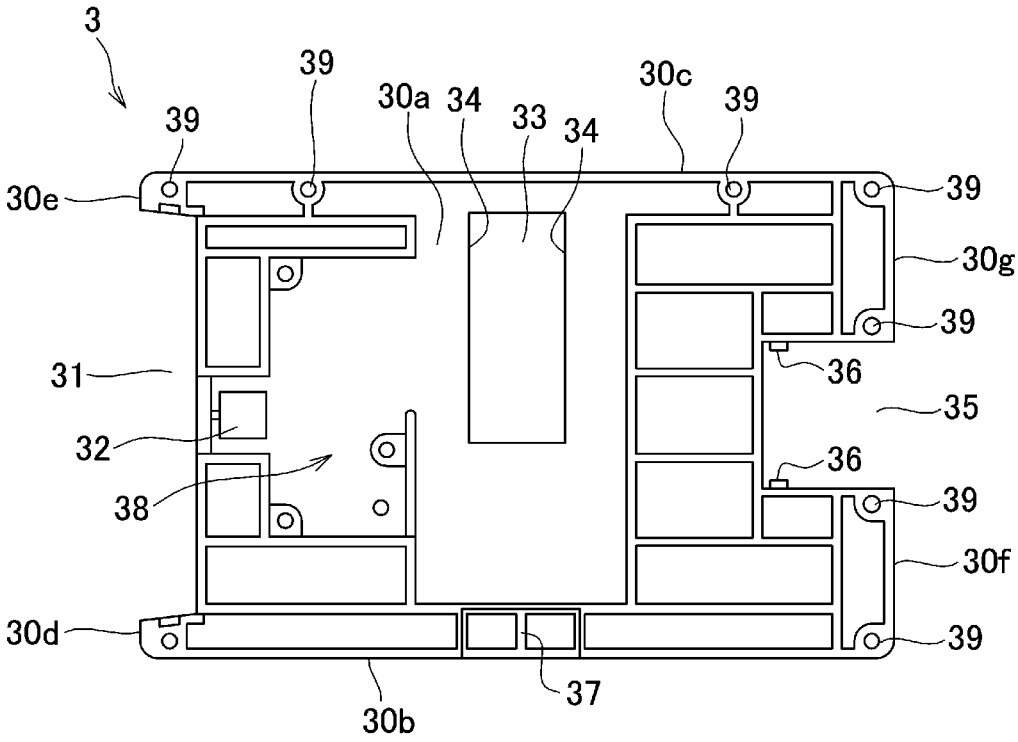
FIG. 18 is a bottom view of an upper case of a business card case/name card case according to the invention.
Figure 19:
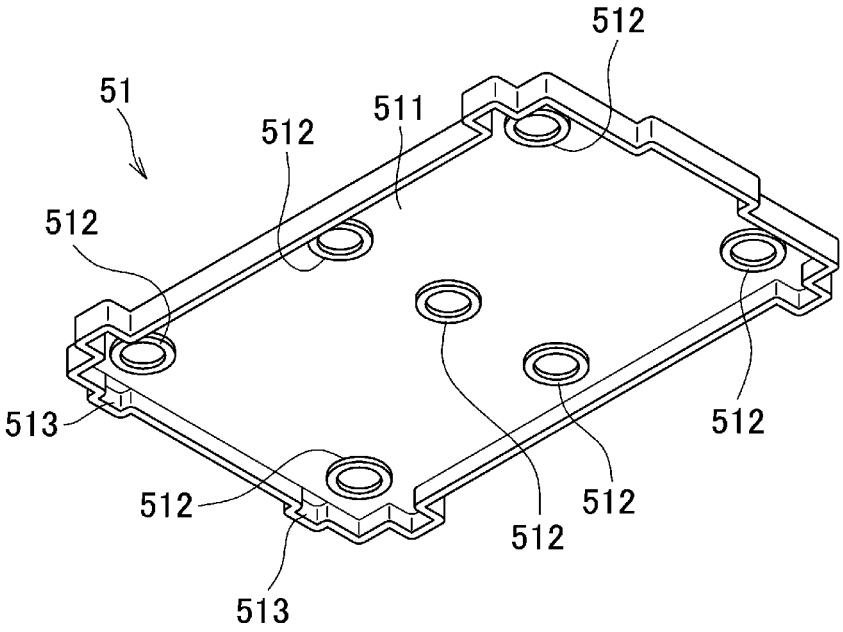
FIG. 19 is a perspective view showing a push-up plate of a business card case/name card case according to the invention, as viewed from a bottom surface.
Figure 20:
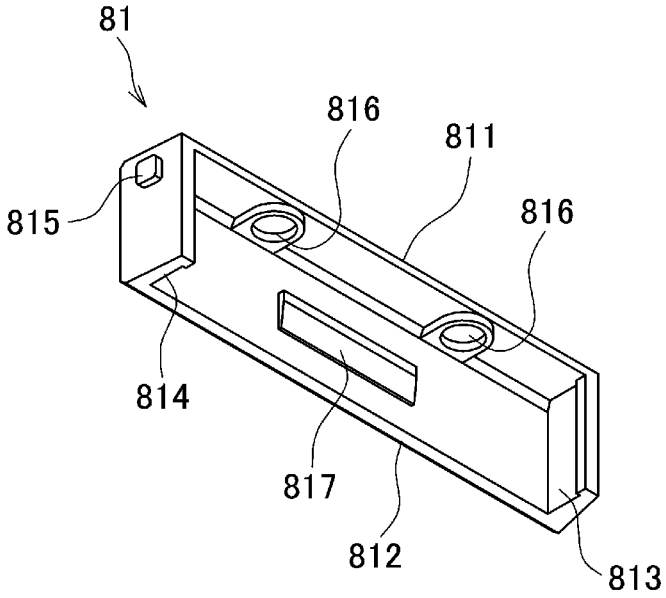
FIG. 20 is a perspective view showing a structure on an inner surface side of an opening/closing cover of a business card case/name card case according to the invention.
Figure 21:
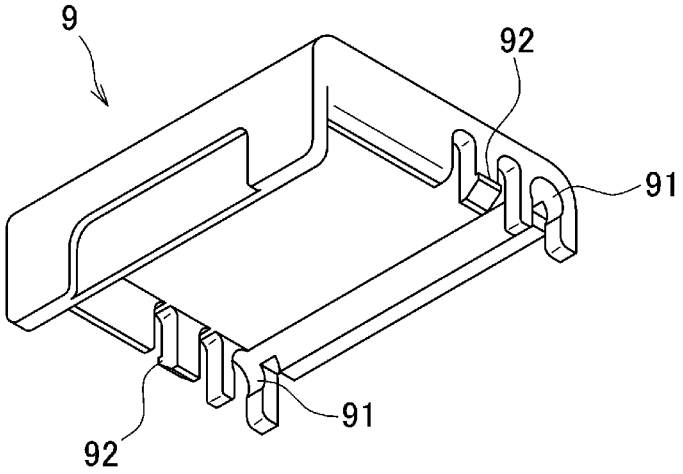
FIG. 21 is a lower side perspective view of a transparent window member of a business card case/name card case according to the invention.

According to the drawings, a card case 1 according to the embodiment comprises a storage case 4 with a card insertion inlet 41 and a card discharging opening 42, wherein the storage case comprises a lower case 2 and an upper case 3, and is capable of accommodating a plurality of cards M stacked inside and fixed to each other, as shown in FIGS. 1 to 6. The lower case 2 and the upper case 3 are firmly fixed to each other by fixing screws 40 inserted into a screw insertion holes 24 of the lower case 2 (FIG. 7) and screwed into retaining screw holes 39 of the upper case 3 (FIG. 18). Otherwise, various fixing means such as caulking, welding and bonding are also acceptable, and a wide range of means for this purpose is possible, as long as the lower case 2 and the upper case 3 are firmly fixed to each other. Inside the storage case 4, a card push-up means 5 for pushing up the whole cards M stored inside toward the upper case is provided.

Figure 7:
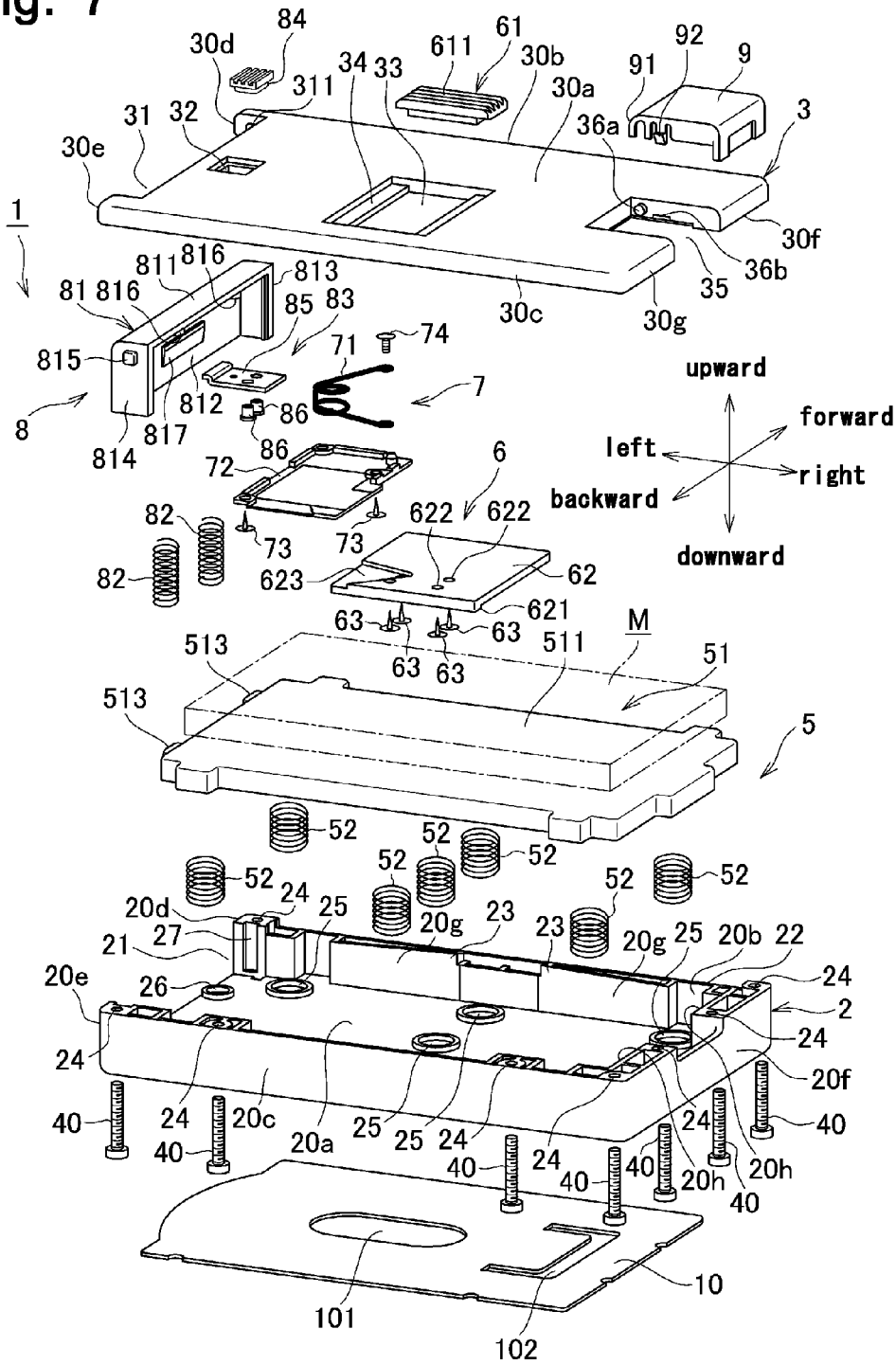
FIG. 7 is an explosive perspective view of a business card case/name card case according to the invention.
Figure 8:
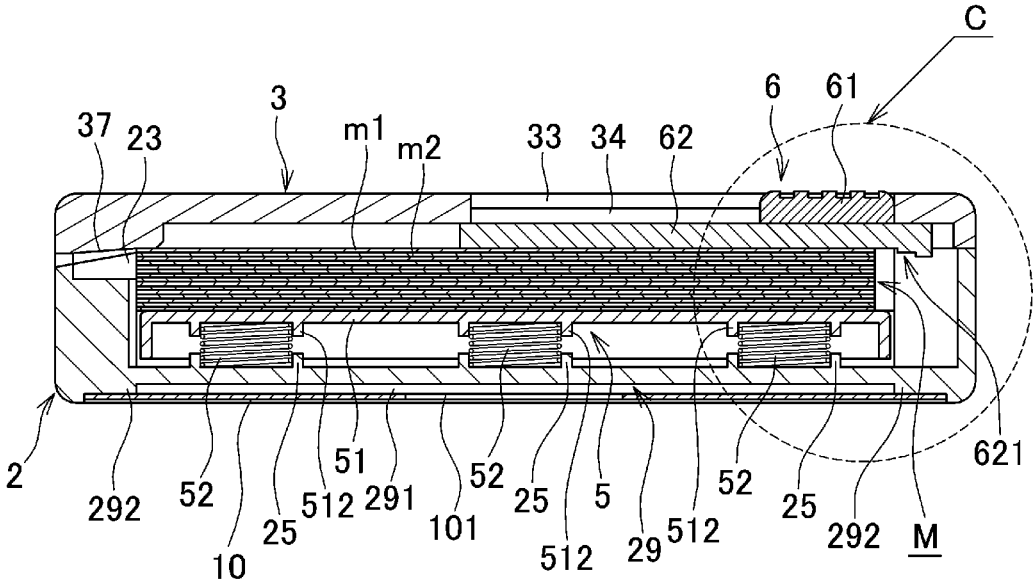
FIG. 8 is a cross sectional view of a business card case/name card case according to the invention along a line A-A of FIG. 1.

As shown in FIG. 7, a card discharging mechanism 6 comprising a push-out plate 62 on the inside and a discharging button member 61 on the outside, wherein they are fixed to each other by retaining screws 63 via a window portion 33 opened substantially on a central portion of an upper case 3, is attached to the upper case 3 in such a manner that the card discharging mechanism is slidable along the window portion 33 toward a card discharging opening 42 as described above. The above-mentioned push-out plate 62 has a locking portion 621 for locking an uppermost card m1 of a plurality of cards M as above described. Details of the card discharging mechanism 6 are described below, in reference to FIGS. 7 to 10.

Figure 11:
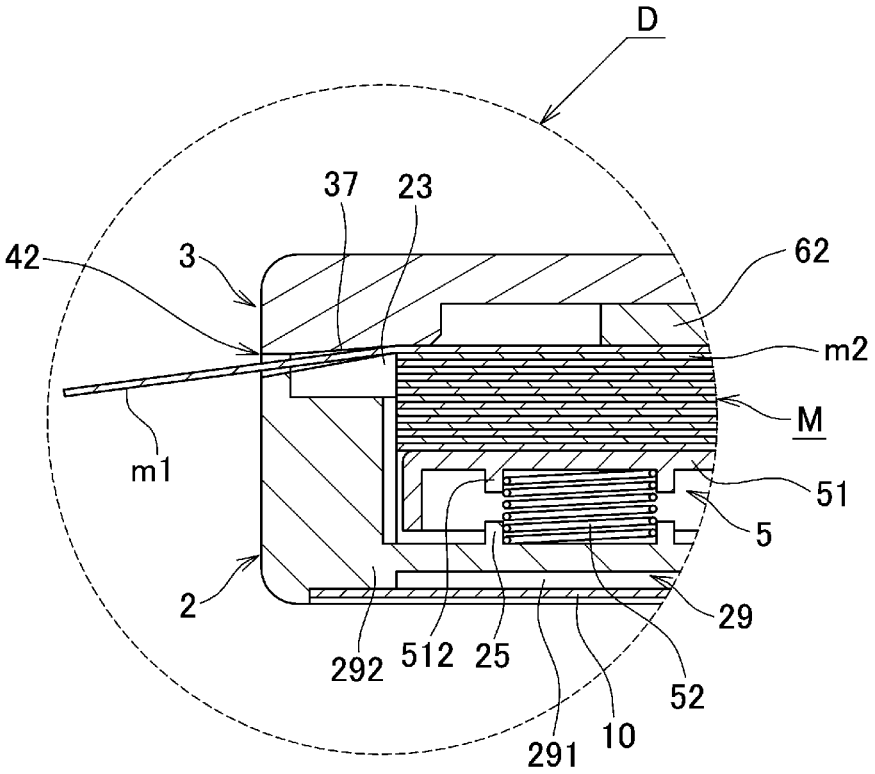
FIG. 11 is an enlarged sectional view of part D in FIG. 9 of a business card case/name card case according to the invention.

A guide portion 37 for inclining obliquely downward a tip of a card to be pushed out by a card discharging mechanism 6 as above described is provided in the vicinity of a card discharging opening 42 as above described; further a stopper 23 (FIGS. 7 and 11) for preventing the second and lower cards (from the uppermost one of a plurality of cards as mentioned above) from being pushed out of the card discharging opening 42 is provided as well.

A stopper 23 is built by shaping a central area of a circumferential wall portion 20*b* on a front side of a lower case 2 in double structure and by inclining an upper edge of a circumferential wall portion 20*g* on an inner side; the highest portion thereof is the stopper 23. A gap for allowing only the uppermost card to pass through is formed between the top of the stopper 23 and a guide portion 37 as mentioned above (FIGS. 8, 9 and 11), and a downward inclination of a card discharging opening 42 by the guide portion 37 has effect that the second and lower cards are pushed down when the uppermost card is pushed out toward the discharging opening. In this manner, passage of the uppermost card only through the gap and prevention of the second and lower ones from passage are both effectively made possible. In the meantime, the form and installation position of the stopper 23 are not limited to those shown in the drawings, but various other types are also acceptable.

A lower case 2 and an upper case 3 are preferably both molded objects by forming them out of synthetic resin, and the lower case 2 comprises a bottom plate 20*a* (FIG. 7) and circumferential wall portions 20*b* to 20*f* provided on a circumference of the bottom plate 20*a*. The upper case 3 comprises a top plate 30*a* and circumferential wall portions 30*b* to 30*g* provided around a circumference of the top plate 30*a*. An upper end edge of the circumferential wall portion 20*b* on a front side of the above-mentioned lower case 2 is shaped as a concave portion 22 one level lower, which is so shaped that it forms a card discharging opening 42 (see FIGS. 2 to 4), when it overlaps the circumferential wall portion 30*b* on a front side of the upper case 3.

A card discharging mechanism 6 as mentioned above is attached substantially to a central portion of an upper case 3 as mentioned above in an above-described manner, and so designed that it is slidable in a forward-backward direction along a rail portion 34 of a window portion 33 opened substantially on a central portion of the upper case 3. In other words, the card discharging mechanism 6 comprises a push-out plate 62 provided on an inner side of the upper case 3, and a discharging button member 61 on the inner side of the above-mentioned upper case 3 and fixed to the above-mentioned push-out plate 62 by a plurality of retaining screws 63, on the window portion 33 opened substantially on the central portion of the upper case 3; the card discharging mechanism is thus so designed that it is slidable in a forward-backward direction along the rail portion 34 of the window portion 33.

Figure 10:
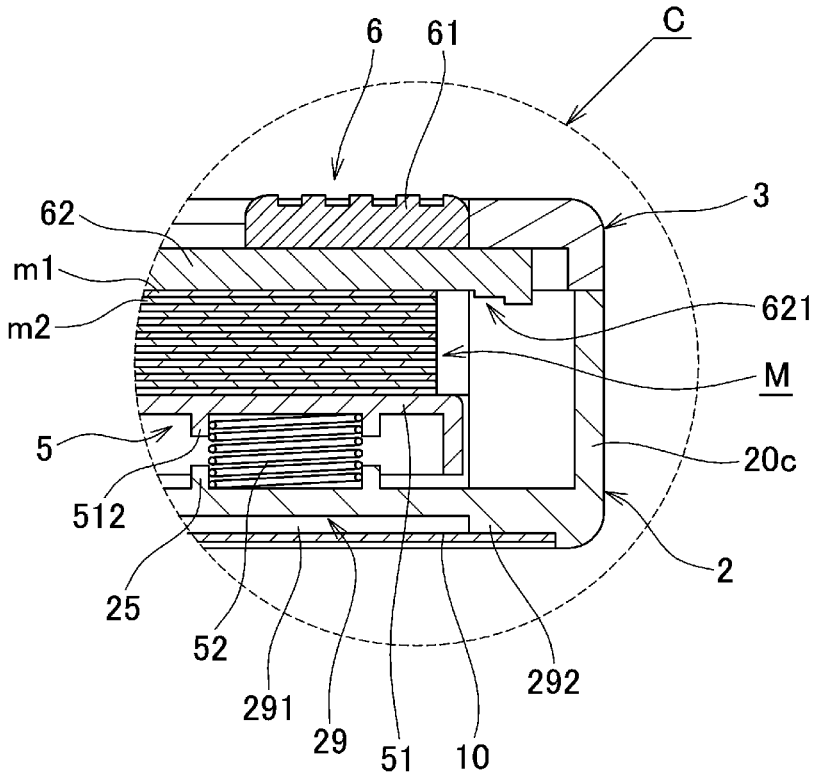
FIG. 10 is an enlarged sectional view of part C in FIG. 8 of a business card case/name card case according to the invention.

It is desirable that a locking portion 621 as mentioned above of a lower surface of a push-out plate 62 is formed in stepped shape of two or more levels, as shown in FIG. 10 and others. In this manner, a second stepped portion or lower can catch the cards, even in case of failure in catching the cards at a first stepped portion, so that a secure discharging operation of cards can be assured.

Figure 22:
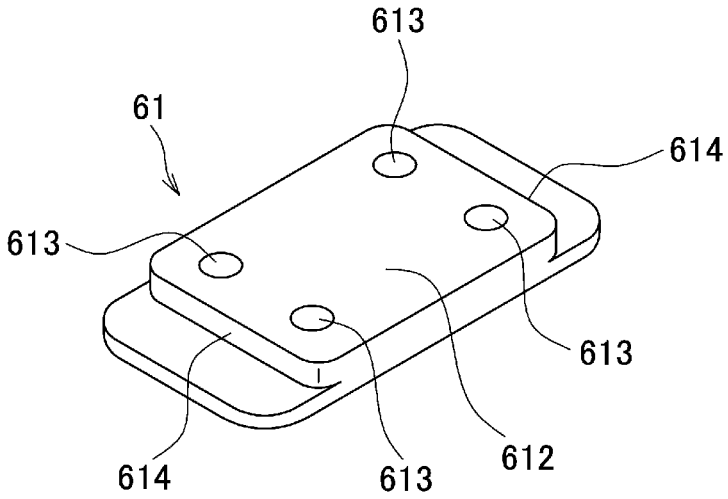
FIG. 22 is a lower side perspective view of a discharging button member of a business card case/name card case according to the invention.
Figure 23:
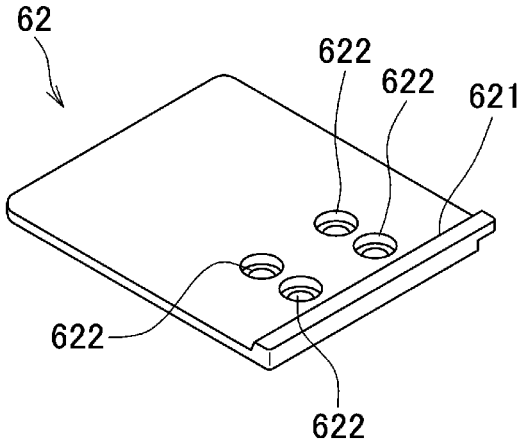
FIG. 23 is a lower side perspective view of a push-out plate of a card discharging mechanism of a business card case/name card case according to the invention.
Figure 24:
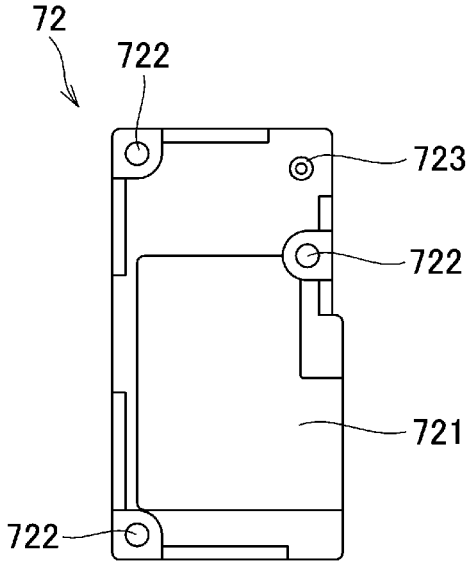
FIG. 24 is a plan view of a spring accommodating cover of an automatic restoration means of a card discharging mechanism of a business card case/name card case according to the invention.

Moreover, a concavo-convex shape is formed on an upper surface 611 of a discharging button member 61, so as to facilitate operations by fingers. Still further, screw holes 613 for screwing retaining screws 63 intended to fix the discharging button member 61 to the push-out plate 62 are provided on a lower surface 612 thereof (FIG. 22), and a stepped portion 614 is formed between the upper surface 611 and the lower surface 612 of the discharging member. Moreover, on the push-out plate 62 (FIG. 23), screw holes 622 into which the above-mentioned retaining screws 63 are inserted are formed, as well as a recess portion 623 (FIG. 7) for allowing a movement of a helical spring 71 as mentioned above on one end side, in addition to a locking portion 621 as mentioned above. When the push-out plate 62 is fixed to the discharging button member 61, a space is generated between the lower surface of the discharging button member 61 and an upper surface of the push-out plate 62 by the above-mentioned stepped portion 614, and a card discharging mechanism 6 is held by inserting the rail portion 34 into the space, so as to be slidable in forward-backward direction along a rail portion 34 of a window portion 33.

Figure 9:
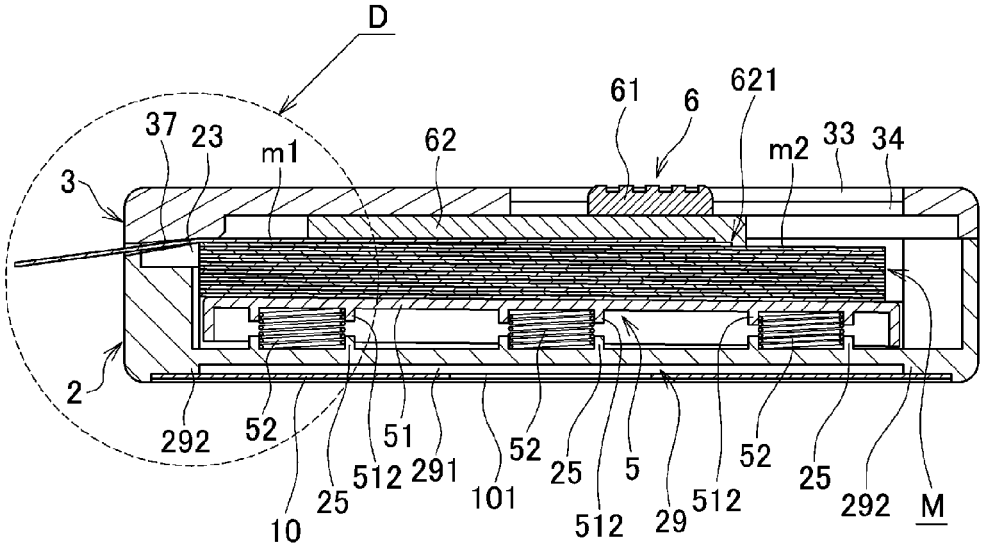
FIG. 9 is a cross sectional view showing one of cards being discharged from a business card case/name card case according to the invention from a state as shown in FIG. 8.

When a user slides a discharging button member 61 in a forward direction from a state as shown in FIGS. 1, 2, 8, 10 and others, a locking portion 621 provided on a rear end portion on a lower surface of a push-out plate 62 can catch the rear end portion of the uppermost card m1 of a plurality of the cards M in the storage case 4 and thus push it forward in this manner (see FIG. 9).

Figure 14:
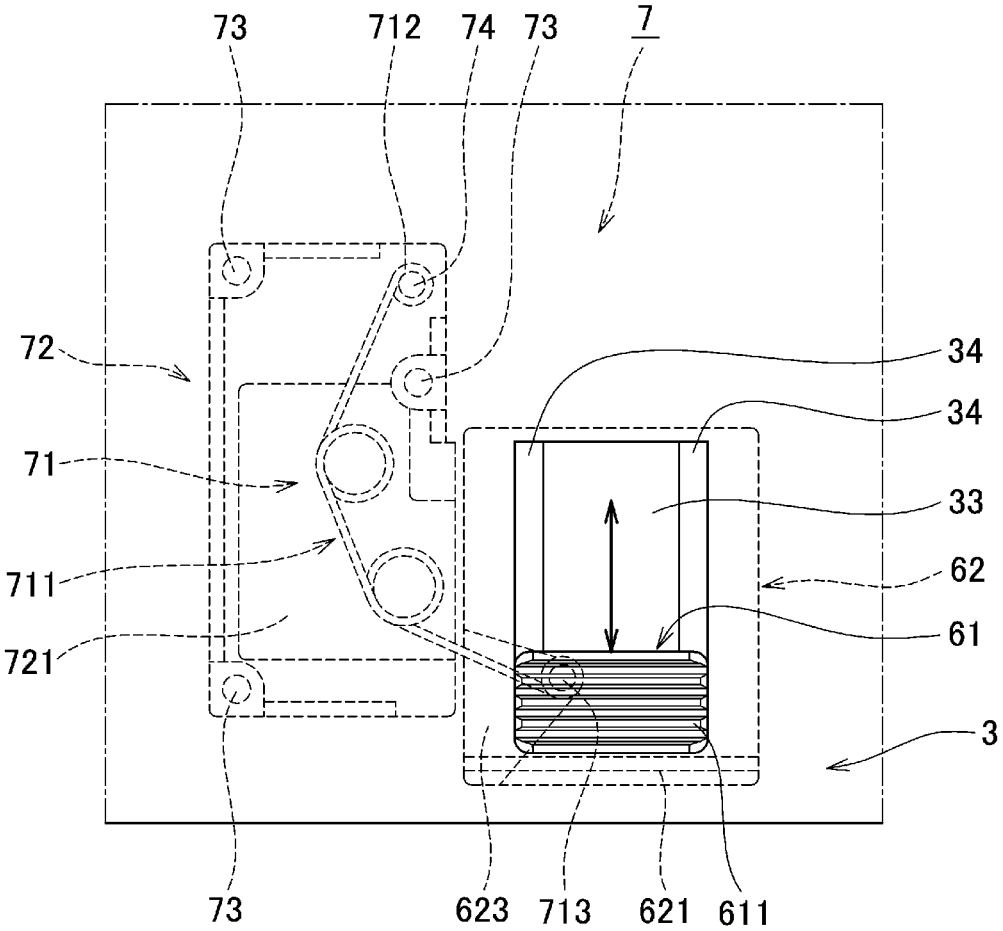
FIG. 14 is an explanatory view of an automatic restoration means of a card discharging mechanism in a business card case/name card case according to the invention, in a state before discharging operation of cards.
Figure 15:
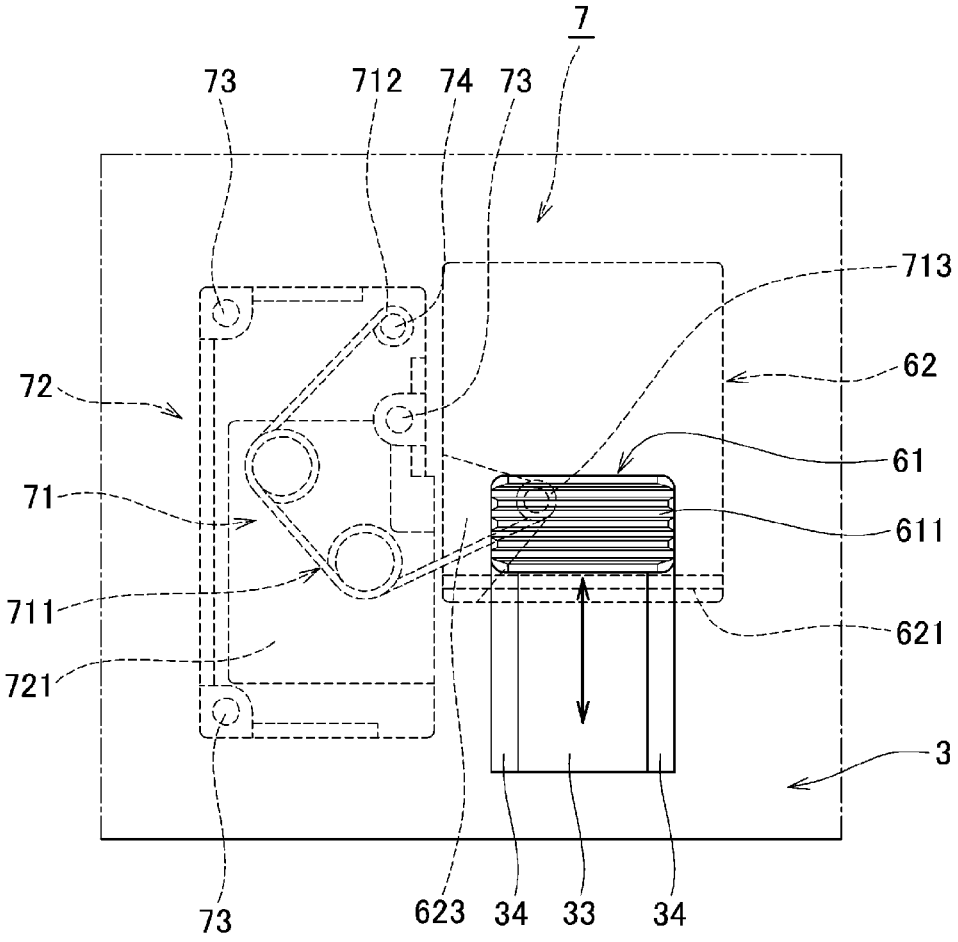
FIG. 15 is an explanatory view of an automatic restoration means of a card discharging mechanism in a business card case/name card case according to the invention, at a time of completion of discharging operation of cards.

In an embodiment as shown in the drawings, a card discharging mechanism 6 as mentioned above is provided with an automatic restoration means 7 for automatically restoring a push-out plate 62 and others to the original position after discharging operation of cards. As shown in FIGS. 7, 14, 15, the automatic restoration means 7 comprises a helical spring 71 and a spring accommodating cover 72 which is attached to an automatic restoration means attaching area 38 (see FIG.

18) on an inner surface of an upper case 3 by a plurality of attaching screws 73 and so designed that an accommodating recess portion 721 of a spring accommodating cover 72 accommodates a main body portion 711 of the helical spring 71. One end portion 712 of the helical spring 71 is rotatably held by a retaining screw 74, while other end portion 713 is inserted into a notch portion 623 provided on a push-out plate 62 and rotatably held by one of retaining screws 63 as mentioned above.

As shown in FIG. 14, when a user slides a discharging button member 61 using his finger in a forward direction from a state before starting discharging operation of a card against the spring force of a helical spring 71 and moves it up to a discharging operation completion position as shown in FIG. 15, and thereafter releases his finger from the discharging button member 61, a card discharging mechanism 6 comprising the discharging button member 61 and a push-out plate 62 is restored by the restoration force of the helical spring 71 to the original position as shown in FIG. 14.

In the meantime, an automatic restoration means 7 can use a tension coil spring, a compression coil spring, a snake spring, a leaf spring or other elastic means, instead of helical spring. If a helical spring 71 is used, the thickness of a storage case 4 can be reduced as much as possible. Moreover, in case of a helical spring using a flat wire, the thickness of the storage case 4 can be further reduced.

Furthermore, an automatic restoration means 7 can be also so designed by modifications in structure and installation of an elastic means that operations for pushing out cards and restoring them to the original position after discharging operation can be both conducted in a semi-automatic manner.

In the meantime, a spring accommodating cover 72 is provided for eliminating a possibility of malfunctions of a helical spring 71 in case of its exposure to the outside, e.g. that the spring gets stuck with a card.

A card push-up means 5 as mentioned above comprises a push-up plate 51 movable in upward-downward direction inside a storage case 4 as mentioned above (see FIGS. 7 to 13) and a plurality of elastic means 52 provided between the push-up plate 51 and a lower case 2 as mentioned above, so as to push up the push-up plate 51.

Dimensions of a push-up plate 51 as mentioned above in forward-backward and horizontal directions are substantially equal to or more than those of a card to be stored, so that warpage and strain of cards can be prevented, malfunctions in discharging operations eliminated and appropriate measures taken against variations in size of cards.

As a plurality of elastic means 52 as mentioned above, a plurality of compression coil springs 52 are preferably used. This is because a coil spring show a high expansion ratio and enable to reduce the thickness of a storage case 4 even in case of accommodating a large number of cards. Moreover, additional grounds for the selection are that it enables to easily adjust elastic modulus, to optimize adjustments depending on situations of use, and to stabilize hold function.

When a storage case is designed in a thickness suitable for portable use, it can accommodate approximately fifteen cards of a normal size.

A lower end portion of each of compression coil springs 52 as mentioned above is fitted into each of a plurality of spring shield portions 25 provided on an inner surface of a bottom plate 20*a* of a lower case 2, while an upper end portion fitted into each of a plurality of spring shield portions 512 provided on a lower surface of an abutment surface 511 of a push-up plate 51. These spring shield portions can be formed integrally with the lower case 2 or with the push-up plate 51, or screwed thereto. In this manner, the lower and the upper end portions of the compression coil springs 52 are fitted into the above-mentioned spring shield portions, so that deformation and malfunctions of these compression coil springs can be prevented. Still further, one has only to fit the lower and the upper end portions of the compression coil springs into the above-mentioned spring shield portions, so that the invention has an effect of reduced manufacturing costs as compared to the conventional products in which leaf springs and others are adhered or screwed.

Moreover, the number and the positions of compression coil springs 52 are so determined in an embodiment as shown in the drawings that difference in push-up load is generated depending on the area of a push-up plate 51: three of the compression coil springs 52 are provided on a central portion, on which a card discharging mechanism 6 as mentioned above catches and pushes forward the uppermost card, so that catching operation as mentioned above is made stable; on the other hand, two of the compression coil springs 52 are provided respectively in the vicinity of end portions right and left, so that excessive pressure is avoided at the time of card inserting and card discharging operations in order to assure the smooth progress of these operations. This is not limited to modifications in the number and the positions of a plurality of elastic means such as compression coil springs as mentioned above, but difference in push-up load depending on the area of a push-up plate 51 can be also achieved by various modifications in form and attaching method of the elastic means.

A card insertion inlet opening/closing means 8 is provided on a card insertion inlet 41 as mentioned above in an embodiment as shown in the drawings. The card insertion inlet opening/closing means 8 comprises an opening/closing cover 81 and a locking mechanism 83 thereof, wherein the opening/closing cover 81 is biased upward (in a closing direction) by compression coil springs 82.

As shown in FIGS. 7, 12, 13, 20 and others, an opening/closing cover 81 of a card insertion inlet 41 comprises a top wall 811, a left-hand wall 812, a front wall 813, a rear wall 814, projections 815, spring shield portions 816 and a locking hook 817; when the storage case 4 is assembled, the opening/closing cover is thus fitted into a position corresponding to a card insertion inlet generating opening 21 of a lower case 2 and a card insertion inlet generating opening 31 of an upper case 3, and the above-mentioned projections 815 are received inside guide grooves 27 of the lower case 2 and guide grooves 311 of the upper case 3, so that the opening/closing cover 81 is attached to the lower case 2 and the upper case 3 so as to be slidable in upward-downward direction. A lower end of each of compression coil springs 82 is fitted onto one of spring shield portions 26 provided on the lower case 2, while an upper end thereof is fitted onto one of the spring shield portions 816 provided on an inner surface of a top wall 811 of the opening/closing cover 81, so that the opening/closing cover 81 is pushed up by the compression coil springs 82 and closed in a normal state.

Figure 1:
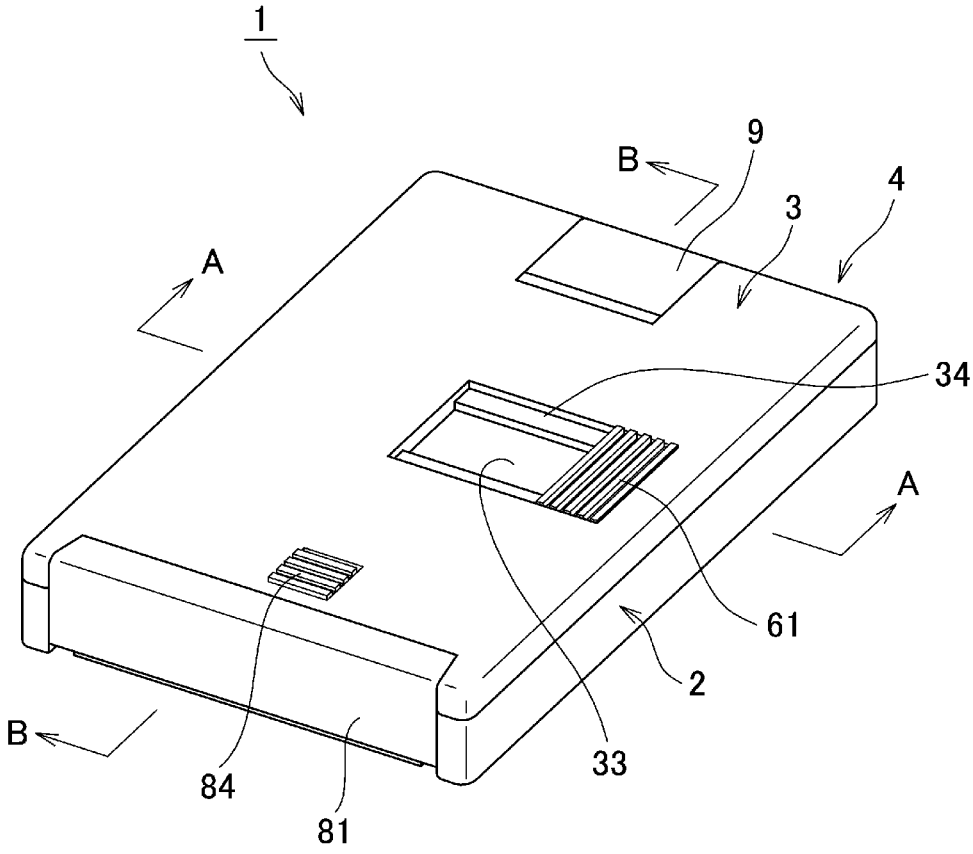
FIG. 1 is a perspective view showing a business card case/name card case according to the invention from one side.
Figure 2:
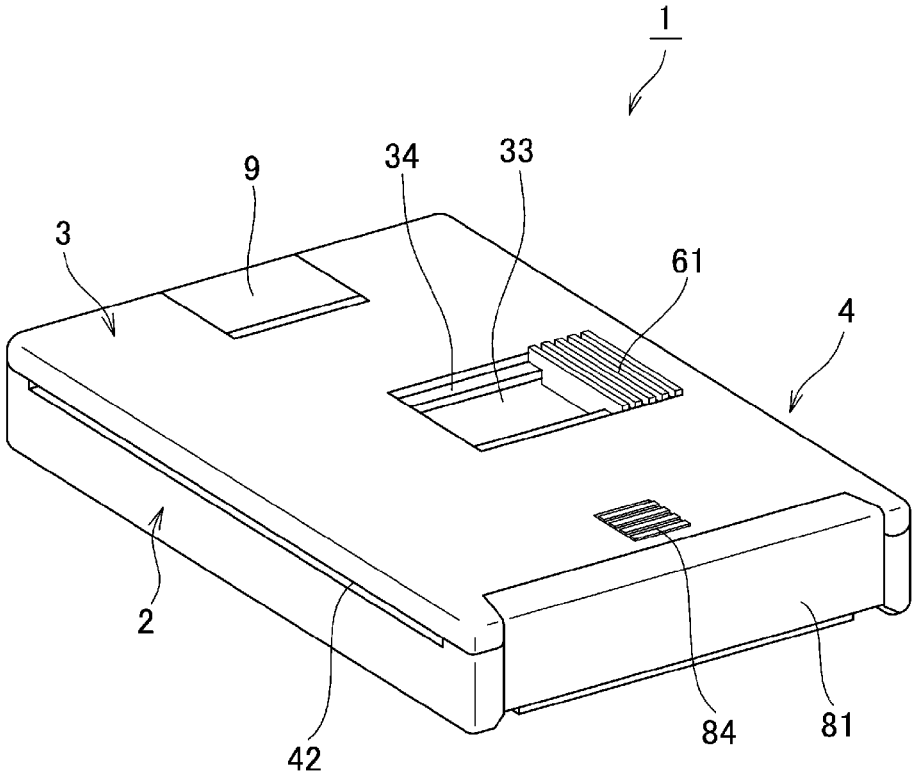
FIG. 2 is a perspective view showing a business card case/name card case according to the invention from other side.
Figure 3:
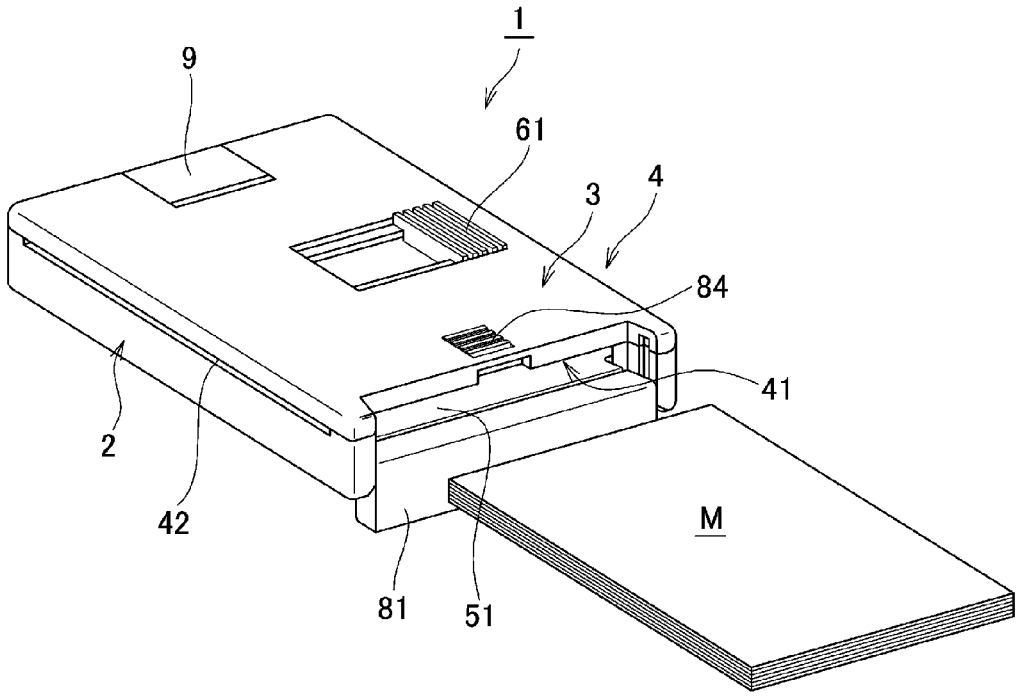
FIG. 3 is a perspective view showing a plurality of cards being stored in a business card case/name card case according to the invention.
Figure 12:
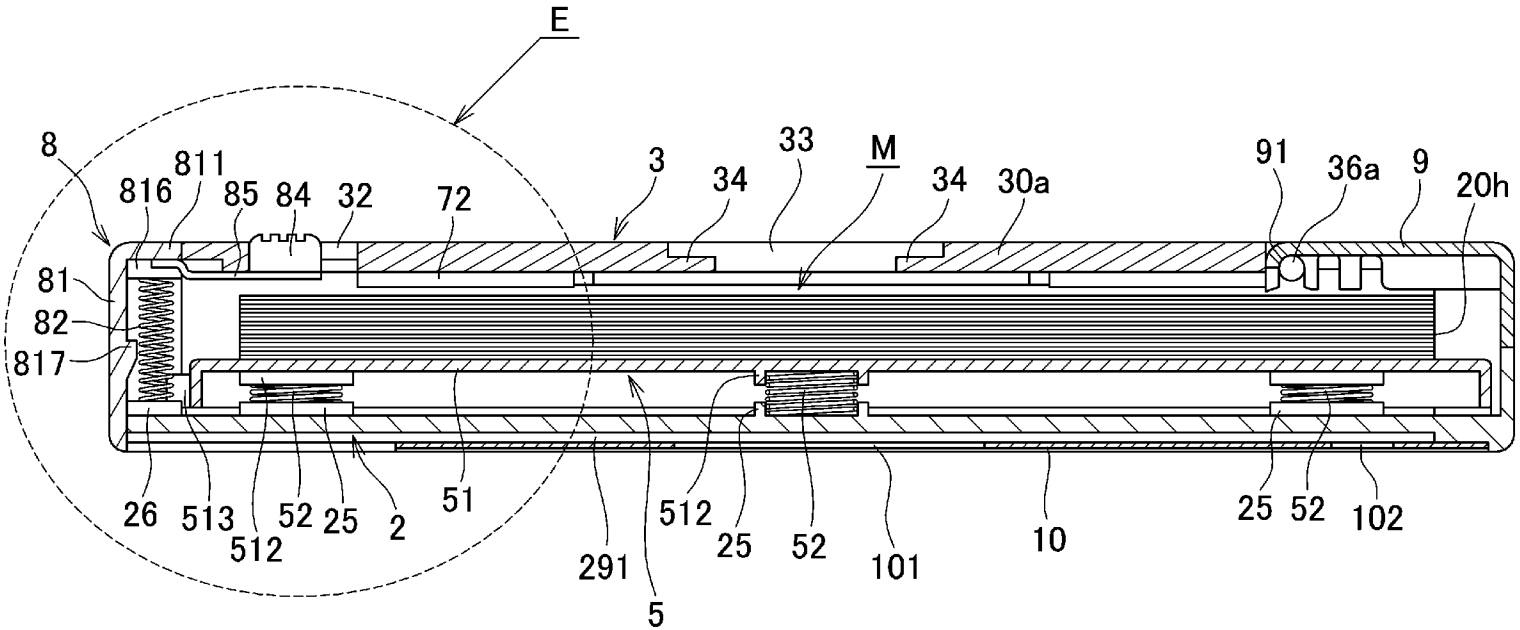
FIG. 12 is a cross sectional view along a line B-B of FIG. 1 of a business card case/name card case according to the invention.
Figure 13:
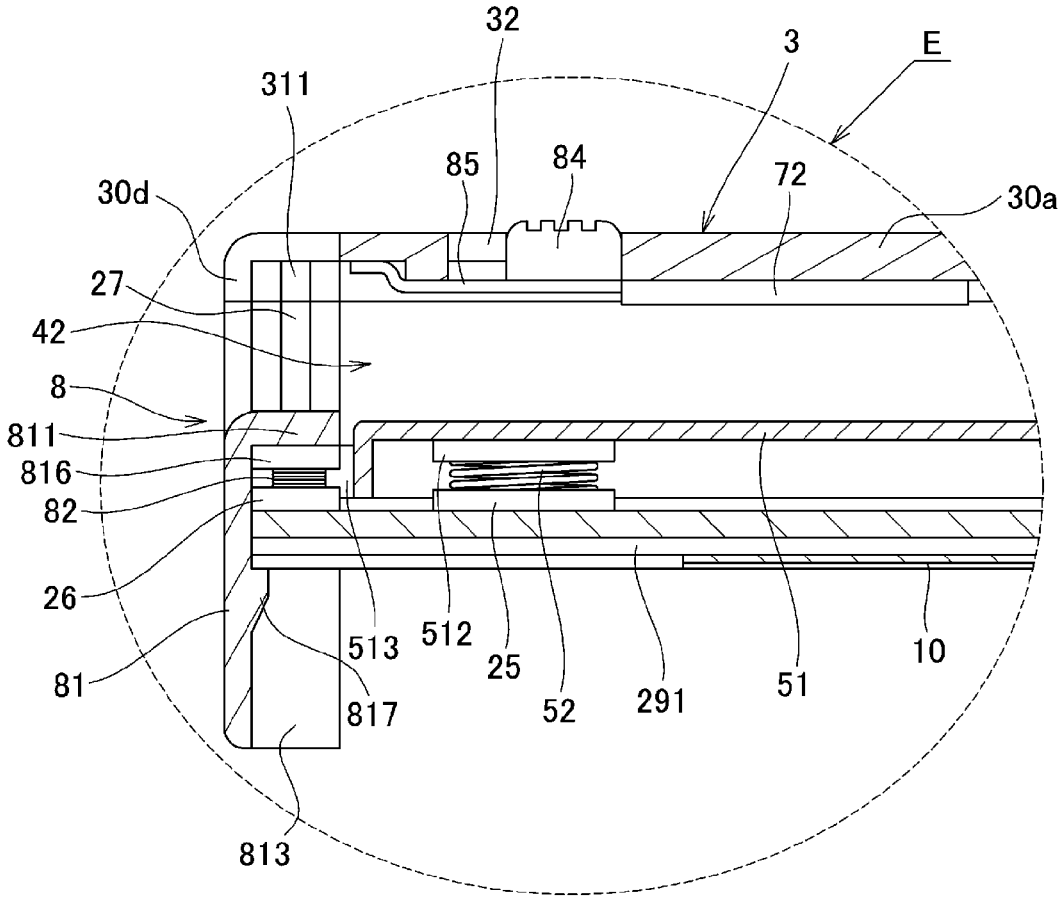
FIG. 13 is an enlarged sectional view showing an opening/closing cover of a card insertion inlet being opened in part E in FIG. 12 of a business card case/name card case according to the invention.

When an opening/closing cover 81 is pushed down by pressing a top wall 811 of the opening/closing cover 81, an inner surface of the top wall 811 of the opening/closing cover 81 is brought into contact with push-down projections 513 of a push-up plate 51, so that the push-up plate 51 is pushed down together with the opening/closing cover 81 (see FIGS. 3 and 13). This facilitates inserting and replacing operations of a plurality of cards M through a card insertion inlet 41. In this case, the push-up plate 51 is first pushed down on the card insertion inlet 41 side, while it is not pushed down yet but simply inclined on the interior side. As the cards M are further inserted, the push-up plate 51 is pushed down on the interior side as well, and the height of the uppermost of the cards M is restricted by a push-out plate 62 as mentioned above, so that the cards M are finally stored in a state in which the push-up plate 51 is parallel to a bottom plate 20*a* of a lower case 2, as shown in FIG. 12. Moreover, when the cards M are sufficiently pushed inside, the tips of the cards hit an inner wall 20*h* of the lower case 2, so that the tips of all of the cards are aligned along the inner wall.

In the meantime, when the opening/closing cover 81 is sufficiently pushed downward, a locking hook 817 as mentioned above provided on an inner wall surface of a left-hand wall 812 of an opening/closing cover 81 is locked on an end edge portion of a bottom plate 20*a* of a lower case 2 (FIG. 13), so that an opened state of the opening/closing cover 81 is maintained. This facilitates discharging and inserting operations of the cards. When the opening/closing cover 81 is pulled to the left in FIG. 13, the locking hook 817 is released and the opening/closing cover 81 is automatically closed by push-up force of compression coil springs 82.

Then, in an embodiment shown in the drawings, a locking mechanism 83 for maintaining a closed state of an opening/closing cover 81 is provided on an upper case 3 as shown in FIG. 7, in order to prevent an unintentional opening of the opening/closing cover 81 while a card case is carried around. The locking mechanism 83 comprises a locking button member 84, a locking piece 85 and fixing screws 86 fixing the both, and it is so attached to a locking button member accommodating hole 32 opened on the upper case 3 that it is slidable in right and left direction in FIG. 7. In other words, the locking button member accommodating hole 32 provided outside the upper case 3 is fixed by fixing screws 86 through the locking button member accommodating hole 32 to the locking piece 85 provided inside the upper case 3; here when the locking button member 84 is slid to the left, the locking piece 85 goes into a space below a top wall 811 of the opening/closing cover 81, in order to check a downward movement of the opening/closing cover 81 by pressure and to prevent the opening/closing cover 81 from opening. When the opening/closing cover 81 is opened, the locking button member 84 is slid to the right, so that the locking piece 85 escapes from the space below the top wall 811 of the opening/closing cover 81, in order to allow for a downward movement of the opening/closing cover 81 by pressure.

In an embodiment shown in the drawings, a transparent window member 9 is provided on a side opposite to the side provided with an opening/closing cover 81 as mentioned above of a storage case 4 as mentioned above, in order to make visible from outside how many cards remain inside.

Figure 5:
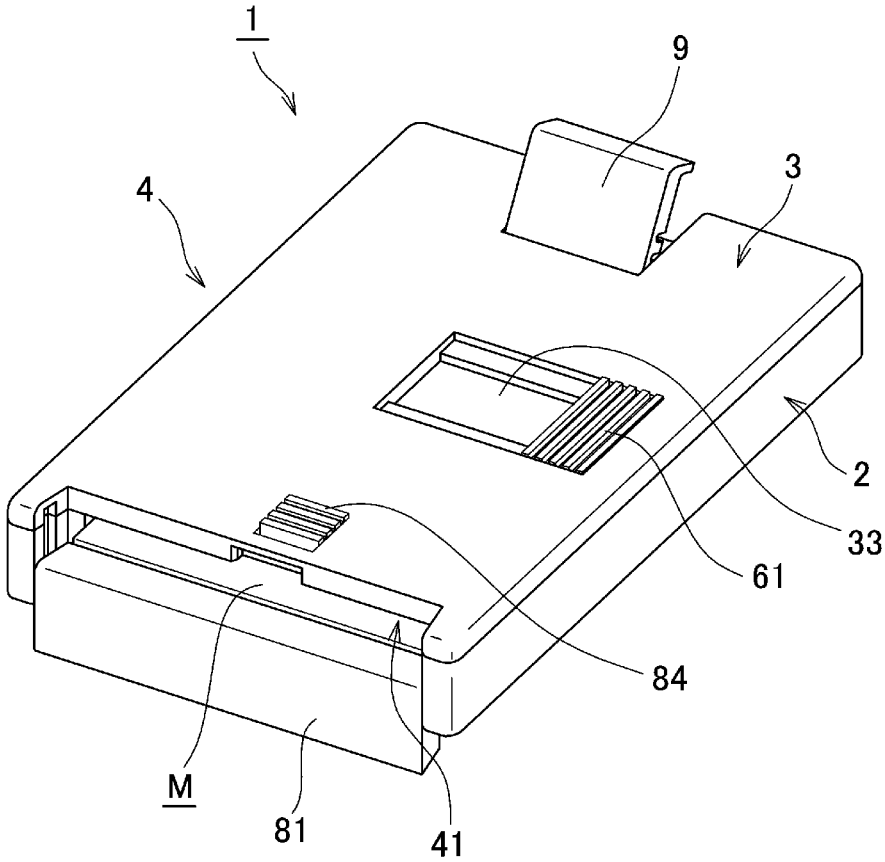
FIG. 5 is a perspective view of an opening/closing cover and a transparent window member on an opposite side of a business card case/name card case according to the invention.
Figure 6:
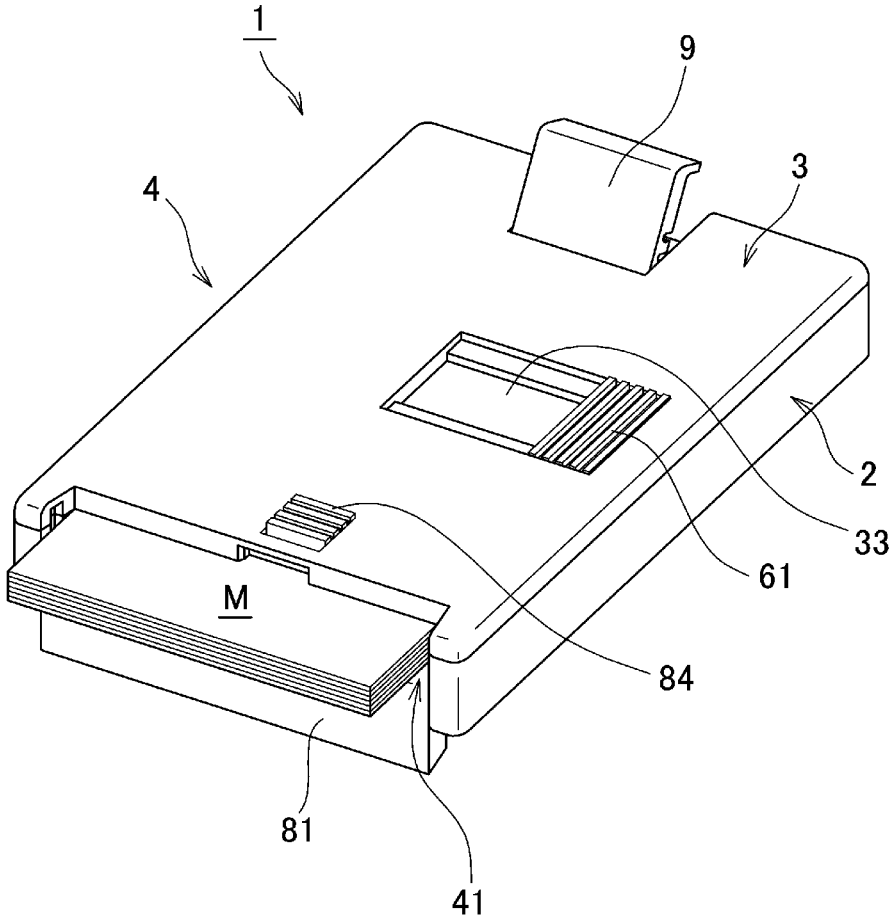
FIG. 6 is a perspective view showing cards inside being replaced in a state as shown in FIG. 5 in a business card case/name card case according to the invention.

Moreover, a transparent window member 9 as mentioned above is made openable/closable and is so designed, as shown in FIGS. 5 and 6, that fingers are inserted into an inlet on the side of the transparent window member 9, while the transparent window member 9 and an opening/closing cover 81 are both opened, so that all the cards inside can be collectively discharged through a card insertion inlet 41 on an opposite side; this facilitates replacing operation of the cards. A transparent window member accommodating notch portion 35 is provided toward a left-hand side of the upper case 3 in an embodiment shown in the drawings, in order to make the transparent window member 9 openable/closable (see FIG. 7); bearing holes 91 shaped on side walls of the transparent window member 9 are fitted to projection shafts 36*a* provided on inner wall surfaces of the transparent window member accommodating notch portion 35. Still further, locking claws 92 are shaped on side walls of the transparent window member 9 (see FIGS. 7 and 9); when the transparent window member 9 is closed, the locking claws 92 are engaged with locking grooves 36*b* shaped on inner wall surfaces of the transparent window member accommodating notch portion 35, so that an unintentional opening of the transparent window member 9 can be prevented.

In an embodiment shown in the drawings, an upper end edge of a circumferential wall portion 20*b* on a front side of a lower case 2 as mentioned above is shaped as a one level lower recess portion 22 (see FIG. 7), which forms a card discharging opening 42 (see FIGS. 2 to 4) together with a circumferential wall portion 30*b* on a front side of an upper case 3, when both portions overlap each other. An arrangement of the card discharging opening 42 along a joint portion between the lower case 2 and the upper case 3 in this manner can prevent malfunctions by cards caught on a card discharging opening 42.

Figure 16:
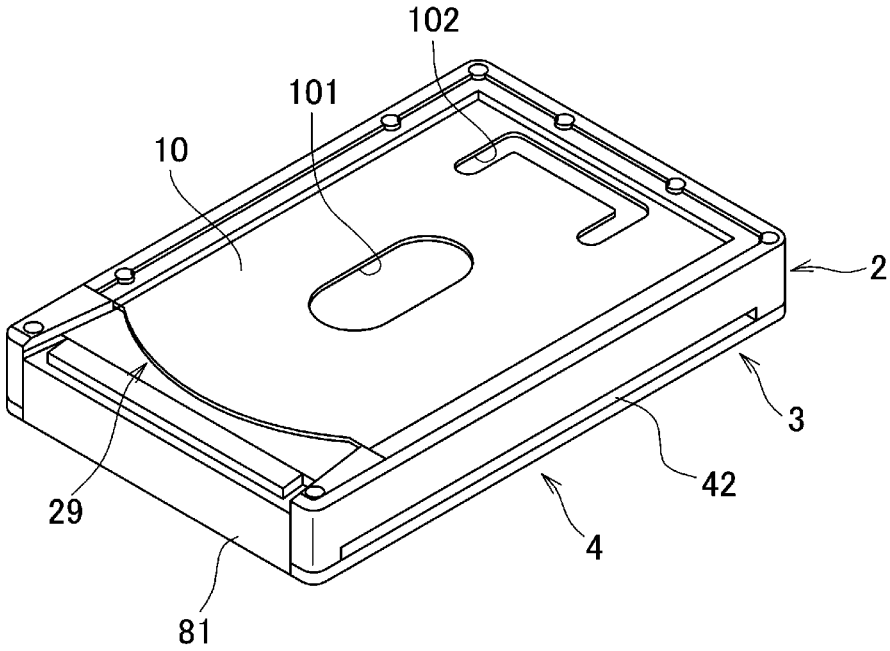
FIG. 16 is a perspective view showing a pocket portion provided on a lower surface of a lower case of a business card case/name card case according to the invention.
Figure 17A:
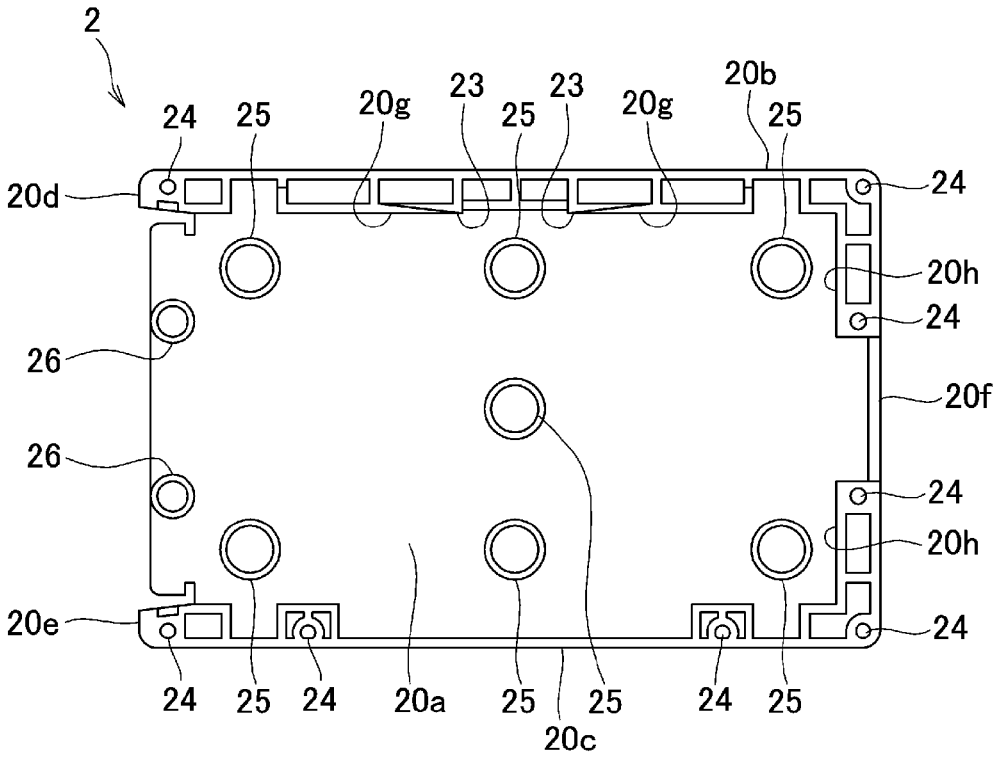
FIG. 17 are views showing a lower case of a business card case/name card case according to the invention, FIG. 17(*a*) being a plan view and FIG. 17(*b*) a perspective view as viewed from a bottom surface.
Figure 17B:
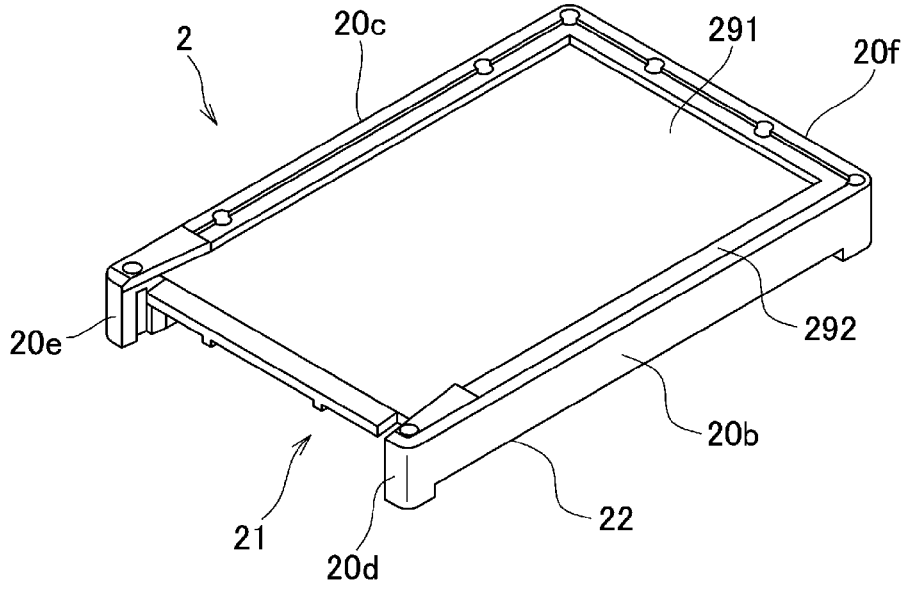

Still further, a pocket portion 29 is provided on a lower surface of a lower case 2, in order to temporarily store cards given from others, cash cards, tickets, receipts and others. The pocket portion 29 comprises a recess 291 shaped on a lower surface of the lower case 2 and a cover plate 10 for overlying it (see FIGS. 7 to 13, 16 and 17). The cover plate 10 is made of a transparent synthetic resin such as e.g. vinyl chloride, and one edge thereof (one edge in an arc shape on the left-hand side in an example shown in FIGS. 7 and 16) is left open and marginal portions on remaining three edges are attached to mound-like portions 292 raised on a circumference of the recess 291 shaped on the lower surface of the lower case 2, using fixing screws 40 as mentioned above. Otherwise, a joint by means of bonding, ultrasonic welding or others is also acceptable. A hole 101 opened on the center of the cover plate 10 is intended to forward housed articles in the pocket portion 29 toward a loading/unloading opening using fingertips, and a U-shaped hole 102 on an inner side is designed to facilitate discharging operation of housed articles deep inside.

Next, reference will be made to operation and effect of the card case according to the invention.

First, in storing the cards inside the storage case 4 of the card case 1 according to the invention, the lock on the above-mentioned locking mechanism 83 is released and the card insertion inlet 41 is opened by pushing down the opening/closing cover 81, as shown in FIG. 3. At this point, an embodiment shown in the drawings ensures that a push-down operation of the opening/closing cover 81 accompanies a push-down operation of the push-up plate 51 by the opening/closing cover 81, in the above-described manner, and that the above-mentioned locking hook 817 shaped on an inner surface of the opening/closing cover 81 is locked on the end edge portion of the bottom plate 20*a* of the lower case 2 so as to maintain the opened state of the opening/closing cover 81; this facilitates inserting operation of multiple cards M (for example approximately fifteen cards).

Furthermore, the invention enables to store and replace the cards through the card insertion inlet 41 provided on the side surface of the storage case 4, with the upper case 3 and the lower case 2 being fixed to each other by fixing screws 40, instead of storing and replacing operations of the cards by dismantling the upper case and the lower case; this assures solidity of the storage case itself and enhances durability performance thereof.

Figure 4:
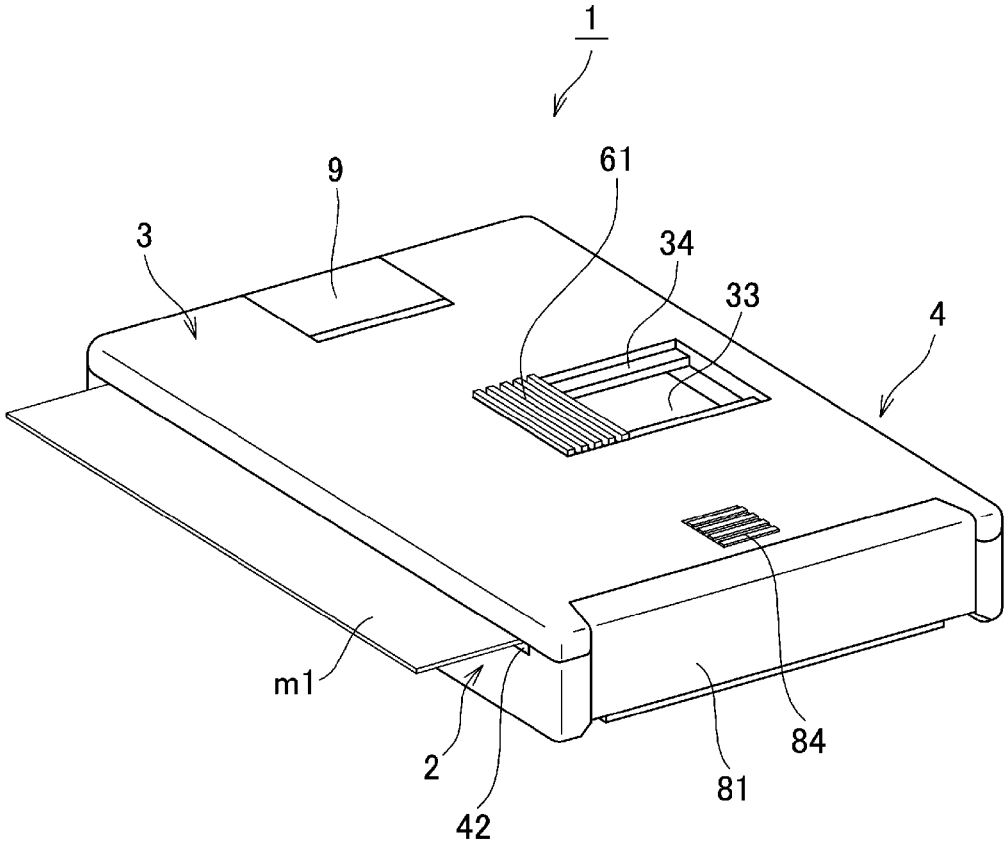
FIG. 4 is a perspective view of showing one of cards being discharged from a business card case/name card case according to the invention.

When one of the cards is discharged, the discharging button member 61 slidably attached to the upper surface of the upper case 3 is slid in the front direction, so that the locking portion 621 provided on the rear end portion on the lower surface of the above-mentioned push-out plate 62 catches the rear end portion of the uppermost card of a plurality of the cards M inside the storage case 4, and pushes it forward (see FIG. 9). At this point, the tip of the card being pushed out is inclined obliquely downward by the guide portion 37 provided in the vicinity of the card discharging opening 42 and the stopper 23 prevents the second and lower cards from being pushed out of the card discharging opening 42, so that the uppermost card only can be securely discharged (FIG. 4). Moreover, since the above-mentioned locking portion 621 on the lower surface of the push-out plate 62 is formed in stepped shape of two or more levels, the uppermost card can be caught on the second or lower stepped portions, even in case that the first stepped portion fails in catching the uppermost card, so that a secure discharging operation of the cards is assured. Still further, the discharging button member 61 is always made ready for use at the prescribed position by the above-mentioned automatic restoration means 7, so that it is not necessary to restore the discharging button member 61 to the original position in discharging the next card, thus improving the operability.

Use of the push-up plate 51 larger than the card to be stored prevents the cards from warpage and strain, and enables to securely discharge the cards to the last one.

Moreover, use of the compression springs with high expansion ratio as elastic means for pushing up the push-up plate 51 enables to reduce thickness of the storage case.

It is possible, whenever one wishes, to check through the transparent window member 9 how many cards remain inside the storage case 4. In the meantime, in case that the opening/closing cover 81 is made of a transparent material, it is also possible to see through the opening/closing cover 81.

In case that multiple cards shall be collectively discharged or replaced with other cards, the fingers are inserted through the transparent window member 9, while both of the transparent window member 9 and the above-mentioned opening/closing cover 81 are opened, in order to discharge multiple cards at once from the card insertion inlet 41 on the opposite side (FIG. 6), and then to insert other cards through the card insertion inlet 41. This facilitates replacing operation of the whole cards.

The cards given from others and the like can be temporarily stored in the pocket portion 29.

The invention is designed as in the foregoing, so that it is possible to provide the card case, wherein the cards stored in the storage case can be securely discharged one by one in a semi-automatic manner to the last one, wherein it shows an excellent durability performance, wherein it is thin with easy storing and replacing operations of the cards, wherein it is readily visible how many cards remain inside the storage case, and wherein it is also possible to temporarily store the cards given from others and the like.

What is claimed is:

1. A card case comprising:

a storage case, comprising a lower case and an upper case, is provided with a card insertion inlet on one side and with a card discharging opening on one other side in a direction perpendicular to said card insertion inlet, said storage case capable of storing a plurality of cards stacked one on top of each other in the inside thereof;

a card insertion inlet opening/closing means comprising an opening/closing cover provided so as to be slidable in an upward-downward direction perpendicular to said insertion inlet;

a card push-up means comprising a push-up plate moveable in an upward-downward direction inside a storage case and elastic means provided so as to push up the push-up plate;

a card discharging mechanism having a discharging button member with a locking portion for locking the uppermost one of said plurality of cards, said discharge button member being provided so as to be slidable toward the card discharging opening;

an automatic restoration means having an elastic means, said automatic restoration means automatically restoring said discharging button member to the original position after slide operation of said discharging button member towards said card discharging button; and wherein said card discharging opening is defined between an edge of a side of the lower case and an edge of a side of the upper case;

wherein a central portion of the side of the lower case which defines the card discharging opening comprises a stopper, said stopper having downward inclination portions in a direction of discharge, said stopper being shaped such that a highest portion of an upper edge of the downward inclination portions is higher than the edge of said side of the lower case which defines the card discharging opening;

wherein a central portion of the side of the upper case which defines the card discharging opening comprises a guide portion, said guide portion having a downward inclination portion in the direction of discharge, wherein said guide portion as a whole has less downward inclination than said downward inclination portions of the stopper.

2. The card case according to claim 1, wherein said locking portion of said card discharging mechanism is formed in stepped shape of two or more levels.

3. The card case according to claim 1, wherein an opening/closing cover is engaged with said push-up plate, and said opening/closing cover is so designed that said push-up means is pushed down on the card insertion inlet side, together with said opening/closing cover, when the latter is pushed down.

4. The card case according to claim 3, wherein an openable/closable transparent window member is provided on a side opposite to the side with said opening/closing cover.

5. The card case according to claim 1, wherein a pocket portion is provided on a lower surface of said lower case of said storage case in order to more distinctly claim the subject matter.

* * * * *